US005749583A

United States Patent [19]

Sadounichvili et al.

[11] Patent Number: 5,749,583

[45] Date of Patent: May 12, 1998

[54] APPARATUS AND METHOD OF PLAYING AN EXPANDED CHESS GAME

[76] Inventors: Tengiz Sadounichvili; Larisa Sadounichvili, both of 5950 Bathurst St., Apt. #605, North York, Ontario, Canada, M2R 1Y9

[21] Appl. No.: 832,446

[22] Filed: Apr. 3, 1997

[51] Int. Cl.[6] ..... A63F 3/02

[52] U.S. Cl. ..... 273/261; 273/260; 273/284

[58] Field of Search ..... 273/260, 261, 273/287, 284

[56] References Cited

U.S. PATENT DOCUMENTS

| | | | |
|---|---|---|---|
| 1,674,553 | 6/1928 | Templeton | 273/284 |
| 3,610,626 | 10/1971 | Nolte | 273/284 |
| 4,856,789 | 8/1989 | Carlson | 273/261 |
| 5,275,414 | 1/1994 | Stephens et al. | 273/261 |
| 5,280,913 | 1/1994 | Sirk | 273/261 |
| 5,642,885 | 7/1997 | Gustin | 273/261 |

FOREIGN PATENT DOCUMENTS

| | | | |
|---|---|---|---|
| 1189106 | 6/1985 | Canada | 273/260 |
| 2201351 | 9/1988 | United Kingdom | 273/260 |

*Primary Examiner*—Benjamin H. Layno

[57] ABSTRACT

A new Apparatus and Method of Playing An Expanded Chess Game for adding new challenges to the traditional game of chess and increasing the interest in the game of chess. The inventive device includes a rectangular game board having a playing surface consisting of sixteen rows and sixteen columns of alternating colored squares, a reducer having four lateral sides in surrounding relationship with a rectangular aperture formed between the lateral sides, the reducer being positionable upon the rectangular game board and forming a reduced playing surface consisting of twelve rows and twelve columns of alternating colored squares, a first set of game pieces for play upon the playing surface consisting of a king, a queen, two rooks, two bishops, two knights, thirty two pawns and two each of new pieces knight-3, knight-2, bishop-3 and bishop-2, and a second set of game pieces for play upon the playing surface consisting of a king, a queen, two rooks, two bishops, two knights, thirty two pawns and two each of new pieces knight-3, knight-2, bishop-3 and bishop-2, the second set of game pieces being distinguishable from the first set of game pieces. The movement of the new pieces is governed by new rules while the pieces from the traditional chess game operate according to the rules of a traditional chess game with the exception that the castling move is modified and the king has an additional move. A subset of the first set of game pieces and a subset of the second set of game pieces are used for play upon the reduced playing surface.

19 Claims, 9 Drawing Sheets

APPARATUS AND METHOD OF PLAYING AN EXPANDED CHESS GAME

BACKGROUND OF THE INVENTION

1. Field of the Invention

The present invention relates to chess games and more particularly pertains to a new Apparatus and Method of Playing An Expanded Chess Game for adding new challenges to the traditional game of chess and increasing the interest in the game of chess.

2. Description of the Prior Art

The use of chess games is known in the prior art. More specifically, chess games heretofore devised and utilized are known to consist basically of familiar, expected and obvious structural configurations, notwithstanding the myriad of designs encompassed by the crowded prior art which have been developed for the fulfillment of countless objectives and requirements.

Known prior art chess games include U.S. Pat. No. 5,011,159; U.S. Pat. No. 5,449,178; U.S. Pat. No. 5,275,414; U.S. Pat. No. 5,280,913; U.S. Pat. No. 5,421,582 and U.S. Pat. No. Des. 317,791.

While these devices fulfill their respective, particular objectives and requirements, the aforementioned patents do not disclose a new Apparatus and Method of Playing An Expanded Chess Game. The inventive device includes a rectangular game board having a playing surface consisting of sixteen rows and sixteen columns of alternating colored squares, a reducer having four lateral sides in surrounding relationship with a rectangular aperture formed between the lateral sides, the reducer being positionable upon the rectangular game board and forming a reduced playing surface consisting of twelve rows and twelve columns of alternating colored squares, a first set of game pieces for play upon the playing surface consisting of a king, a queen, two rooks, two bishops, two knights, thirty two pawns and two each of new pieces knight-3, knight-2, bishop-3 and bishop-2, and a second set of game pieces for play upon the playing surface consisting of a king, a queen, two rooks, two bishops, two knights, thirty two pawns and two each of new pieces knight-3, knight-2, bishop-3 and bishop-2, the second set of game pieces being distinguishable from the first set of game pieces. The movement of the new pieces is governed by rules set forth hereinafter while the pieces from the traditional chess game operate according to the rules of a traditional chess game with the exception that the castling move is modified and the king has an additional move. A subset of the first set of game pieces and a subset of the second set of game pieces are used for play upon the reduced playing surface.

In these respects, the Apparatus and Method of Playing An Expanded Chess Game according to the present invention substantially departs from the conventional concepts and designs of the prior art, and in so doing provides an apparatus primarily developed for the purpose of adding new challenges to the traditional game of chess and increasing the interest in the game of chess.

SUMMARY OF THE INVENTION

In view of the foregoing disadvantages inherent in the known types of chess games now present in the prior art, the present invention provides a new Apparatus and Method of Playing An Expanded Chess Game construction wherein the same can be utilized for adding new challenges to the traditional game of chess and increasing the interest in the game of chess.

The general purpose of the present invention, which will be described subsequently in greater detail, is to provide a new Apparatus and Method of Playing An Expanded Chess Game which has many of the advantages of the chess games mentioned heretofore and many novel features that result in a new Apparatus and Method of Playing An Expanded Chess Game which is not anticipated, rendered obvious, suggested, or even implied by any of the prior art chess games, either alone or in any combination thereof.

To attain this, the present invention generally comprises a rectangular game board having a playing surface consisting of sixteen rows and sixteen columns of alternating colored squares, a reducer having four lateral sides in surrounding relationship with a rectangular aperture formed between the lateral sides, the reducer being positionable upon the rectangular game board and forming a reduced playing surface consisting of twelve rows and twelve columns of alternating colored squares, a first set of game pieces for play upon the playing surface consisting of a king, a queen, two rooks, two bishops, two knights, thirty two pawns and two each of new pieces knight-3, knight-2, bishop-3 and bishop-2, and a second set of game pieces for play upon the playing surface consisting of a king, a queen, two rooks, two bishops, two knights, thirty two pawns and two each of new pieces knight-3, knight-2, bishop-3 and bishop-2, the second set of game pieces being distinguishable from the first set of game pieces. The movement of the new pieces is governed by rules set forth hereinafter while the pieces from the traditional chess game operate according to the rules of a traditional chess game with the exception that the castling move is modified and the king has an additional move. A subset of the first set of game pieces and a subset of the second set of game pieces are used for play upon the reduced playing surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Apparatus and Method of Playing An Expanded Chess Game which has many of the advantages of the chess games mentioned heretofore and many novel features that result in a new Apparatus and Method of Playing An Expanded Chess Game which is not anticipated, rendered obvious, suggested, or even implied by any of the prior art chess games, either alone or in any combination thereof.

It is another object of the present invention to provide a new Apparatus and Method of Playing An Expanded Chess Game which may be easily and efficiently manufactured and marketed.

It is a further object of the present invention to provide a new Apparatus and Method of Playing An Expanded Chess Game which is of a durable and reliable construction.

An even further object of the present invention is to provide a new Apparatus and Method of Playing An Expanded Chess Game which is susceptible of a low cost of manufacture with regard to both materials and labor, and which accordingly is then susceptible of low prices of sale to the consuming public, thereby making such Chess Game economically available to the buying public.

Still yet another object of the present invention is to provide a new Apparatus and Method of Playing An Expanded Chess Game which provides in the apparatuses and methods of the prior art some of the advantages thereof, while simultaneously overcoming some of the disadvantages normally associated therewith.

Still another object of the present invention is to provide a new Apparatus and Method of Playing An Expanded Chess Game for adding new challenges to the traditional game of chess and increasing the interest in the game of chess.

Yet another object of the present invention is to provide a new Apparatus and Method of Playing An Expanded Chess Game which includes a rectangular game board having a playing surface consisting of sixteen rows and sixteen columns of alternating colored squares, a reducer having four lateral sides in surrounding relationship with a rectangular aperture formed between the lateral sides, the reducer being positionable upon the rectangular game board and forming a reduced playing surface consisting of twelve rows and twelve columns of alternating colored squares, a first set of game pieces for play upon the playing surface consisting of a king, a queen, two rooks, two bishops, two knights, either sixteen or thirty two pawns and two each of new pieces knight-3, knight-2, bishop-3 and bishop-2, and a second set of game pieces for play upon the playing surface consisting of a king, a queen, two rooks, two bishops, two knights, either sixteen or thirty two pawns and two each of new pieces knight-3, knight-2, bishop-3 and bishop-2, the second set of game pieces being distinguishable from the first set of game pieces. The movement of the new pieces is governed by rules set forth hereinafter while the pieces from the traditional chess game operate according to the rules of a traditional chess game with the exception that the castling move is modified and the king has an additional move. A subset of the first set of game pieces and a subset of the second set of game pieces are used for play upon the reduced playing surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
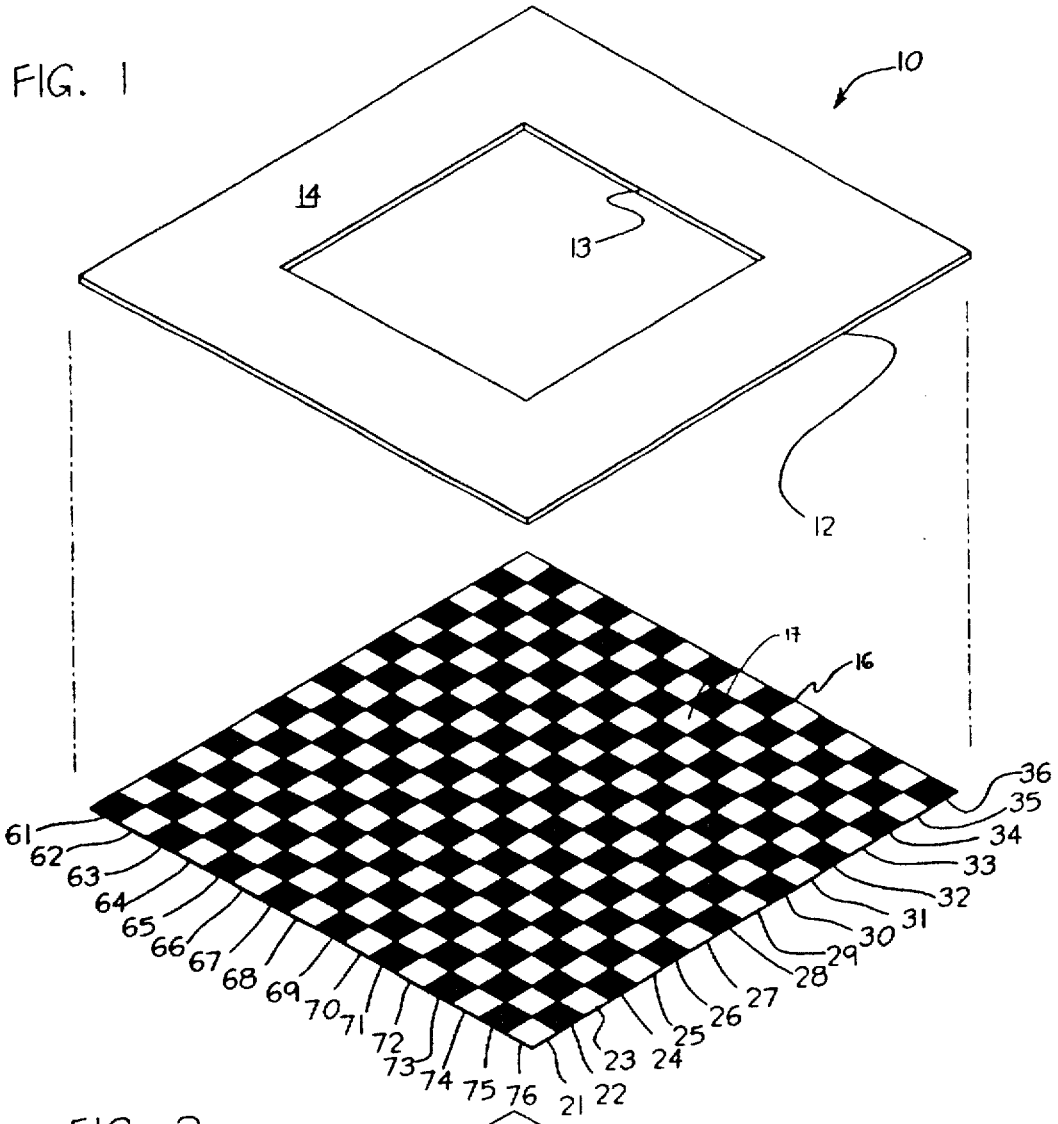
FIG. 1 is a fragmented perspective view of a new Expanded Chess Game Apparatus according to the present invention.

With reference now to the drawings, and in particular to FIGS. 1 through 14 thereof, a new Apparatus and Method of Playing An Expanded Chess Game embodying the principles and concepts of the present invention and generally designated by the reference numeral 10 will be described.

More specifically, it will be noted that the Apparatus and Method of Playing An Expanded Chess Game 10 comprises a rectangular game board 16 having a playing surface 17 consisting of sixteen rows and sixteen columns of alternating colored squares, a reducer 12 having four lateral sides 14 in surrounding relationship with a rectangular aperture 13 formed between the lateral sides 14, the reducer 12 being positionable upon the rectangular game board 16 and forming a reduced playing surface 18 consisting of twelve rows and twelve columns of alternating colored squares, a first set of game pieces for play upon the playing surface consisting of a king, a queen, two rooks, two bishops, two knights, thirty two pawns and two each of new pieces knight-3, knight-2, bishop-3 and bishop-2, and a second set of game pieces for play upon the playing surface consisting of a king, a queen, two rooks, two bishops, two knights, thirty two pawns and two each of new pieces knight-3, knight-2, bishop-3 and bishop-2, the second set of game pieces being distinguishable from the first set of game pieces.

For illustrative clarity, the game pieces are each represented in the Figures by the following symbols:

K=King

Q=Queen

N=Knight

B=Bishop

R=Rook

P=Pawn

B2=Bishop-2

N2=Knight-2

B3=Bishop-3

N3=Knight-3

The symbols for the first player's set of playing pieces are represented on a white circular background and the symbols for the second player's set of playing pieces are represented on a black circular background.

With reference to FIG. 1, the rectangular game board 16 is shown having sixteen rows of alternating colored squares including a first row 21, a second row 22, a third row 23, a fourth row 24, a fifth row 25, a sixth row 26, a seventh row 27, a eighth row 28, a ninth row 29, a tenth row 30, an eleventh row 31, a twelfth row 32, a thirteenth row 33, a fourteenth row 34, a fifteenth row 35 and a sixteenth row 36. Also shown are sixteen columns of alternating colored squares including a first column 61, a second column 62, a third column 63, a fourth column 64, a fifth column 65, a sixth column 66, a seventh column 67, a eighth column 68, a ninth column 69, a tenth column 70, an eleventh column 71, a twelfth column 72, a thirteenth column 73, a fourteenth column 74, a fifteenth column 75 and a sixteenth column 76. A reducer 12 is also shown removed from the rectangular game board 16.

Figure 2:
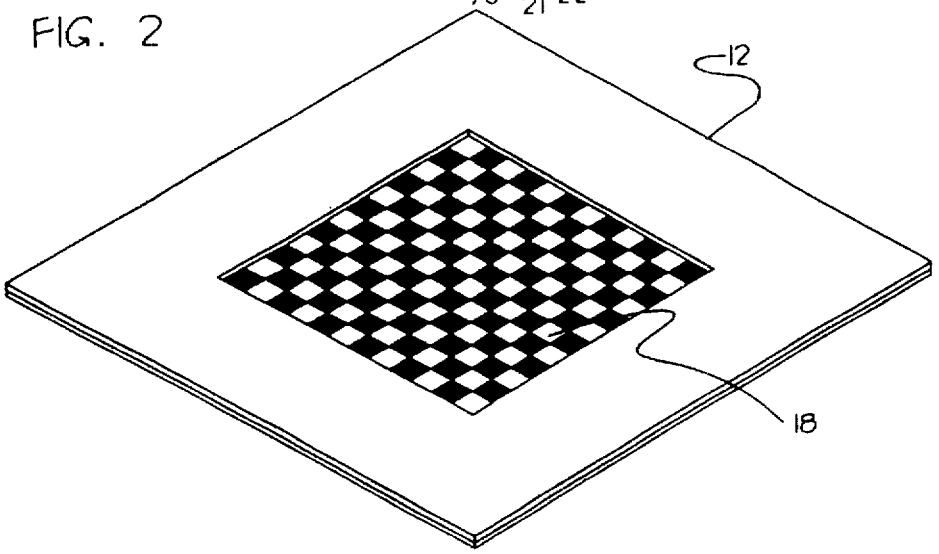
FIG. 2 is a top elevation view thereof showing the reduced playing surface.

With reference to FIG. 2, the reducer 12 is shown positioned over the playing surface 17 forming a reduced playing surface 18 consisting of twelve rows and twelve columns of alternating colored squares.

Figure 3:
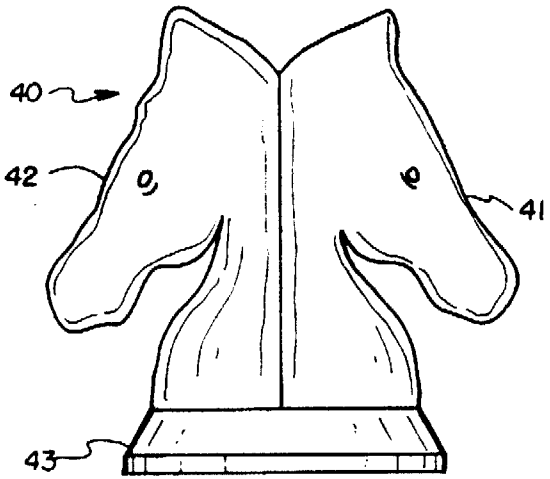
FIG. 3 is plan view of the knight-2 game piece.

With reference to FIG. 3, a knight-2 game piece is shown including a two headed knight-2 upper portion 40 having a first horse-shaped member 41 attached to a second horse-shaped member 42. The knight-2 upper portion 40 is shown attached to a knight-2 base 43.

Figure 4:
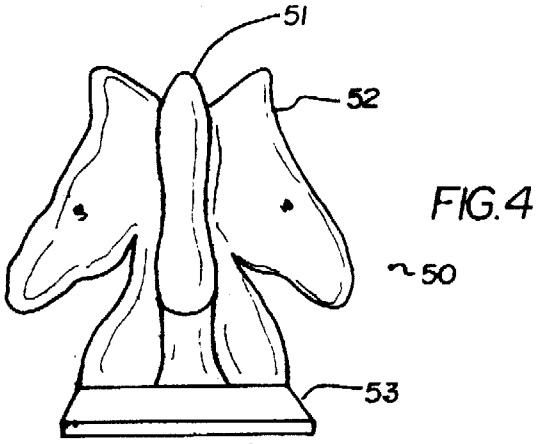
FIG. 4 is a plan view of the knight-3 game piece.

With reference to FIG. 4, a knight-3 game piece is shown including a three headed knight-3 upper portion 50 having two lateral horse-shaped members 52 attached to a middle horse-shaped member 51. The lateral horse-shaped members 52 and the middle horse shaped member 51 extend radially from a common center and are equally spaced apart with 120 degrees between each member. The knight-3 upper portion 50 is shown attached to a knight-3 base 53.

Figure 5:
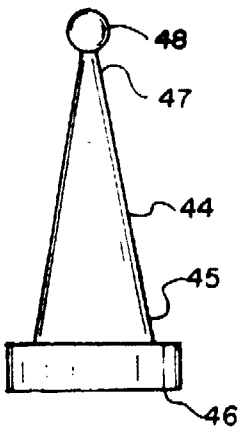
FIG. 5 is plan view of the bishop-2 game piece.

With reference to FIG. 5, a bishop-2 game piece is shown including a conical section 44 having a large end 45 attached to a bishop-2 base 46 and a small end 47. Attached to the small end 47, a bishop-2 ball is shown 48.

Figure 6:
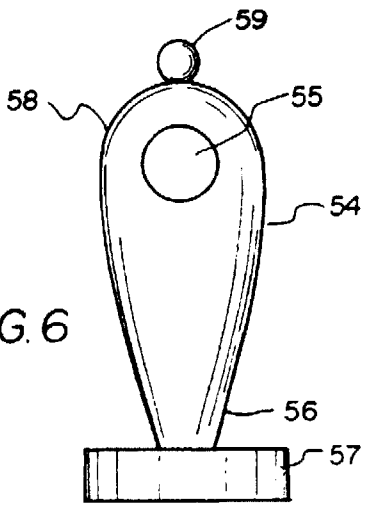
FIG. 6 is a plan view of the bishop-3 game piece

With reference to FIG. 6, a bishop-3 game piece is shown including an elongated section 54 having a bore 55 formed therethrough. The elongated section 54 further includes a narrow end 56 attached to a bishop-3 base 57 and a curved end 58 to which is attached a bishop-3 ball 59.

Figure 7:
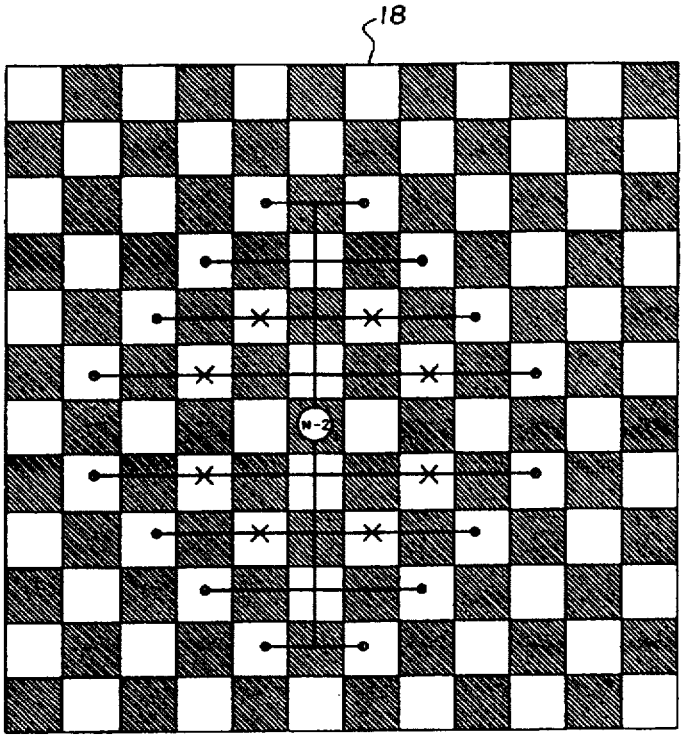
FIG. 7 is a plan view of the playing surface showing the allowable movement of the knight-2 game piece.

With reference to FIG. 7, the allowable moves of the knight-2 game piece are shown. The knight-2 is constrained to move from a knight-2 square of origin marked in FIG. 7 as N-2 to a knight-2 destination square. The possible knight-2 destination squares that a knight-2 may move to includes all allowable destination squares of the knight of the traditional game of chess, marked in FIG. 7 by x's, and in addition all squares arrived at by a movement of the knight-2 game piece six squares inclusive of the knight-2 square of origin in any manner which includes a right angle movement, the movement of the knight-2 excluding diagonal movement. This set of destination squares is marked in FIG. 7 by bullets (•).

Figure 8:
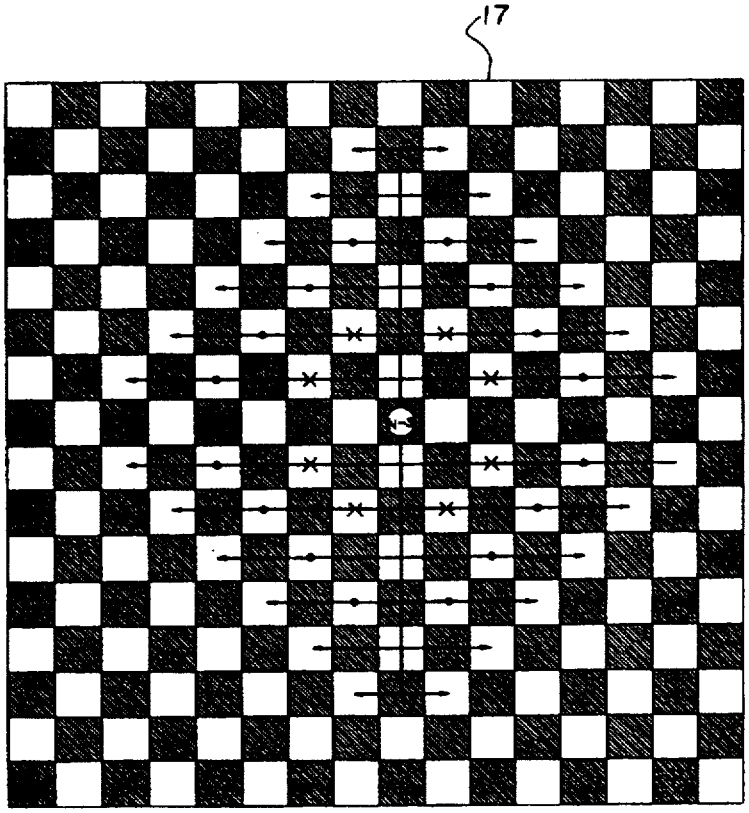
FIG. 8 is a plan view of the playing surface showing the allowable movement of the knight-3 game piece.

With reference to FIG. 8, the allowable moves of the knight-3 game piece are shown. The knight-3 is constrained to move from a knight-3 square of origin marked in FIG. 8 as N-3 to a knight-3 destination square. The possible knight-3 destination squares that a knight-3 may move to includes all allowable destination squares of the knight-2, marked in FIG. 8 by x's and bullets (•), and in addition all squares arrived at by a movement of the knight-3 game piece eight squares inclusive of the knight-3 square of origin in any manner which includes a right angle movement, the movement of the knight-3 excluding diagonal movement. This set of destination squares is marked in FIG. 8 by arrow heads (→).

Figure 9:
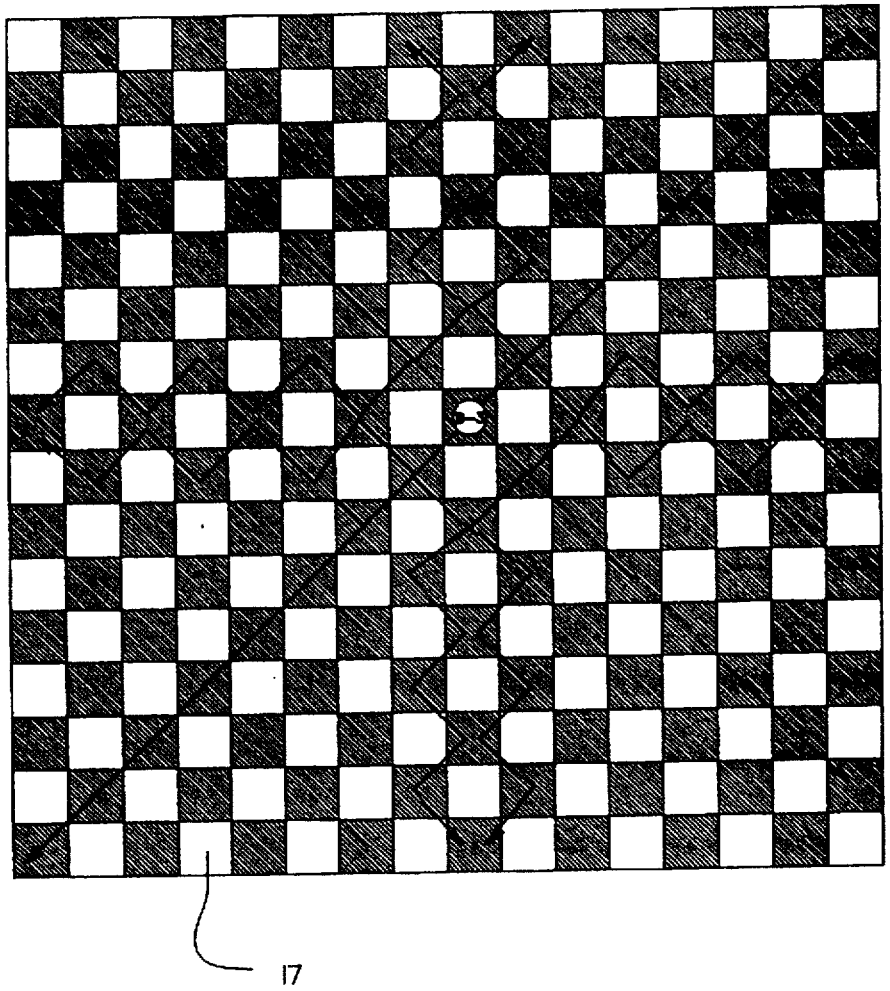
FIG. 9 is a plan view of the playing surface showing the allowable movement of the bishop-3 game piece.

With reference to FIG. 9, the allowable moves of the bishop-3 are shown. The bishop-3 is constrained to move from a bishop-3 square of origin, marked in FIG. 9 as B-3, to a bishop-3 destination square, the bishop-3 destination square including the allowable destination squares of the bishop of the traditional game of chess and in addition all squares arrived at by a movement of the bishop-3 game piece in a zigzag fashion, the bishop-3 destination square being of a same color as a color of the bishop-3 square of origin and located on a row including the bishop-3 square of origin or within one row of the row including the bishop-3 square of origin, or being located on a column including the bishop-3 square of origin or within one column of the column including the bishop-3 square of origin. The bishop-2 game piece is constrained to move in a fashion similar to the bishop-3 but excluding the allowable movement of the bishop of the traditional game of chess.

Figure 11:
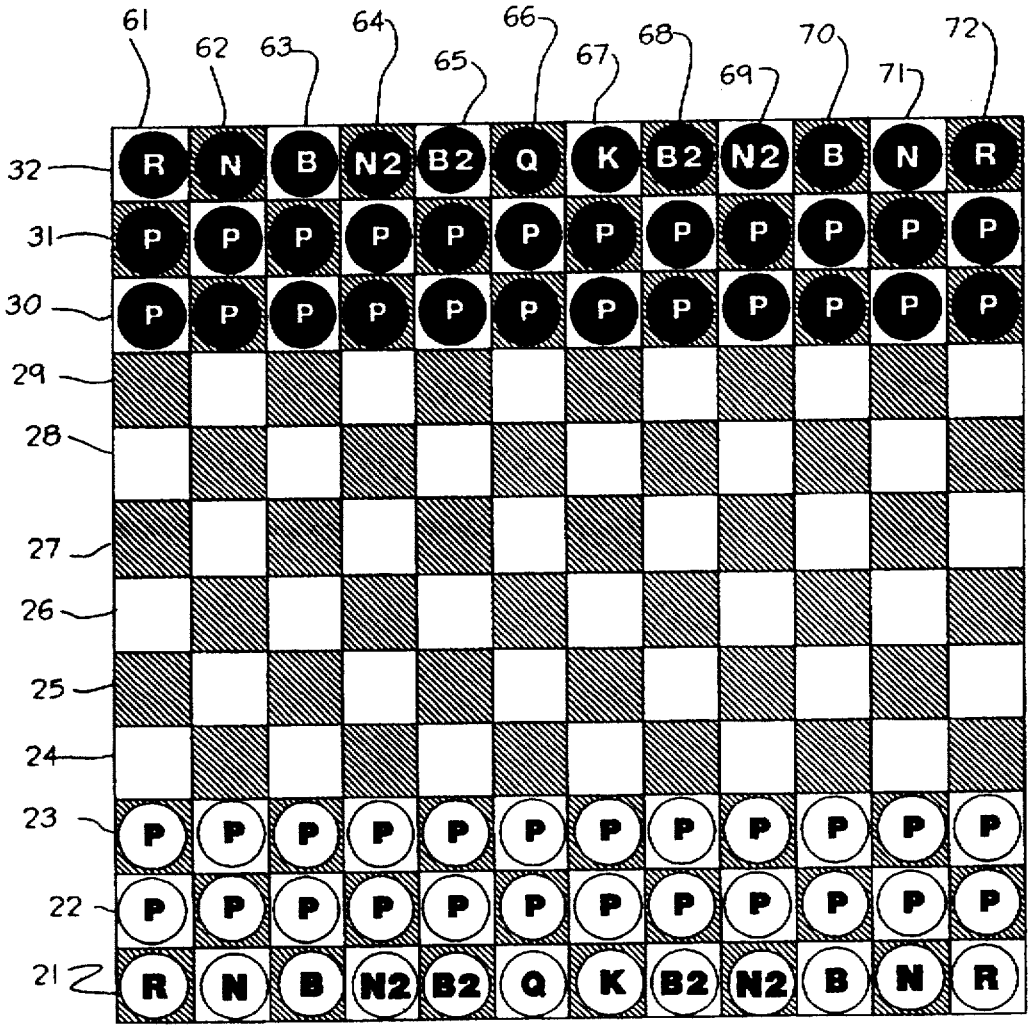
FIG. 11 is a plan view of the playing surface showing the set up of the game pieces with two rows of pawns for each player version of the game on the 12 by 12 squares version of the game board.
Figure 13:
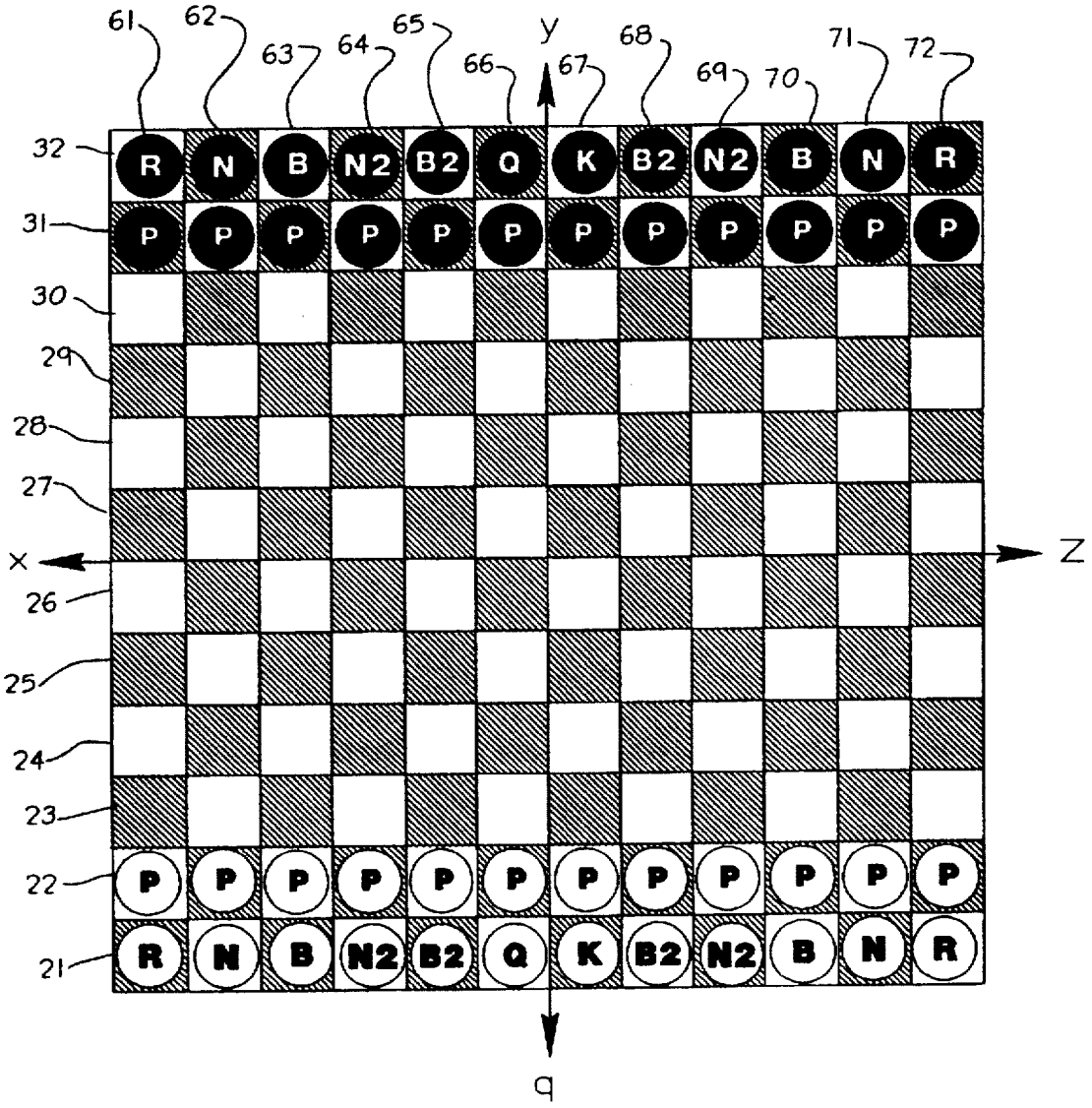
FIG. 13 is a plan view of the playing surface showing the set up of the game pieces with one row of pawns for each player version of the game on the 12 by 12 squares version of the game board.

To play the Expanded Chess Game upon the reduced playing surface, as shown in FIG. 11 and as represented by the previously described symbols, a first player initially places twelve of the first set of game pieces upon the first row, as read from left to right from the first player's vantage point, as rook, knight, bishop, knight-2, bishop-2, queen, king, bishop-2, knight-2, bishop, knight and rook, twelve of the pawns upon the second row and twelve of the pawns upon the third row. A second player initially places twelve of the second set of game pieces upon the twelfth row, as read from left to right from the first player's vantage point, as rook, knight, bishop, knight-2, bishop-2, queen, king, bishop-2, knight-2, bishop, knight, and rook twelve of the pawns upon the eleventh row and twelve of the pawns upon the tenth row. The pieces are placed such that the kings are in a same column. Optionally, as a variant to the game as shown in FIG. 13, both players may play the game with only one row of twelve pawns per player instead of two rows with twenty-four pawns per player. As shown in FIG. 13, in such a variant, the first player sets up his row of twelve pawns only on the second row while the second player sets up his row of twelve pawns only on the eleventh row.

Play begins as in the traditional game of chess with each player moving his pieces in turn while observing the rules of chess and also the allowable movement of the game pieces. The castling move is modified to include the movement of the king at least two squares but not more than three squares in a direction along the initial row of placement and the simultaneous placement of either rook in a square adjacent the king, the square adjacent the king being located on a side opposite a rook square of origin, and provided no other game pieces obstruct the movement of the king or the rook and provided further that the king and rook have not been previously moved.

Figure 12:
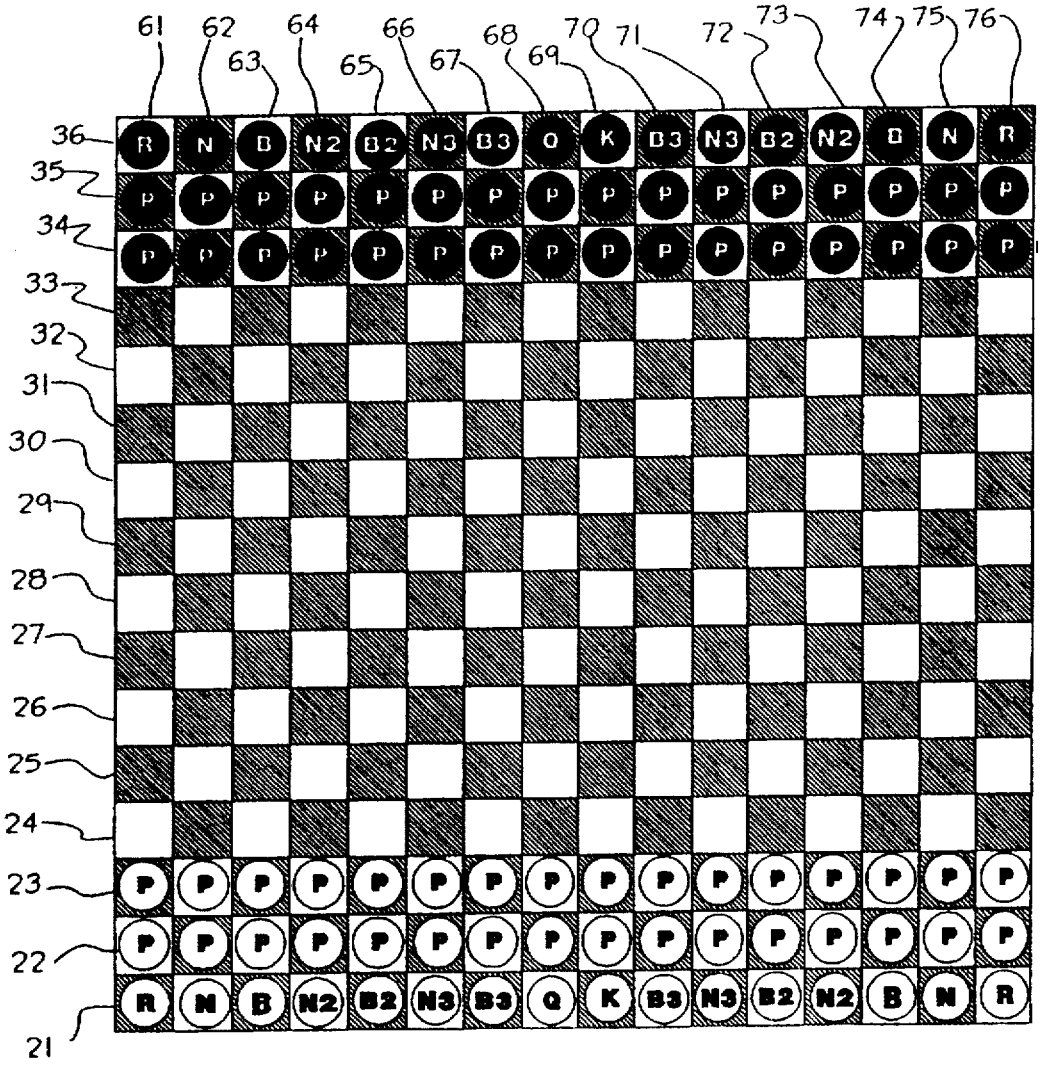
FIG. 12 is a plan view of the playing surface showing the set up of the game pieces with two rows of pawns for each player version of the game on the 16 by 16 squares version of the game board.
Figure 14:
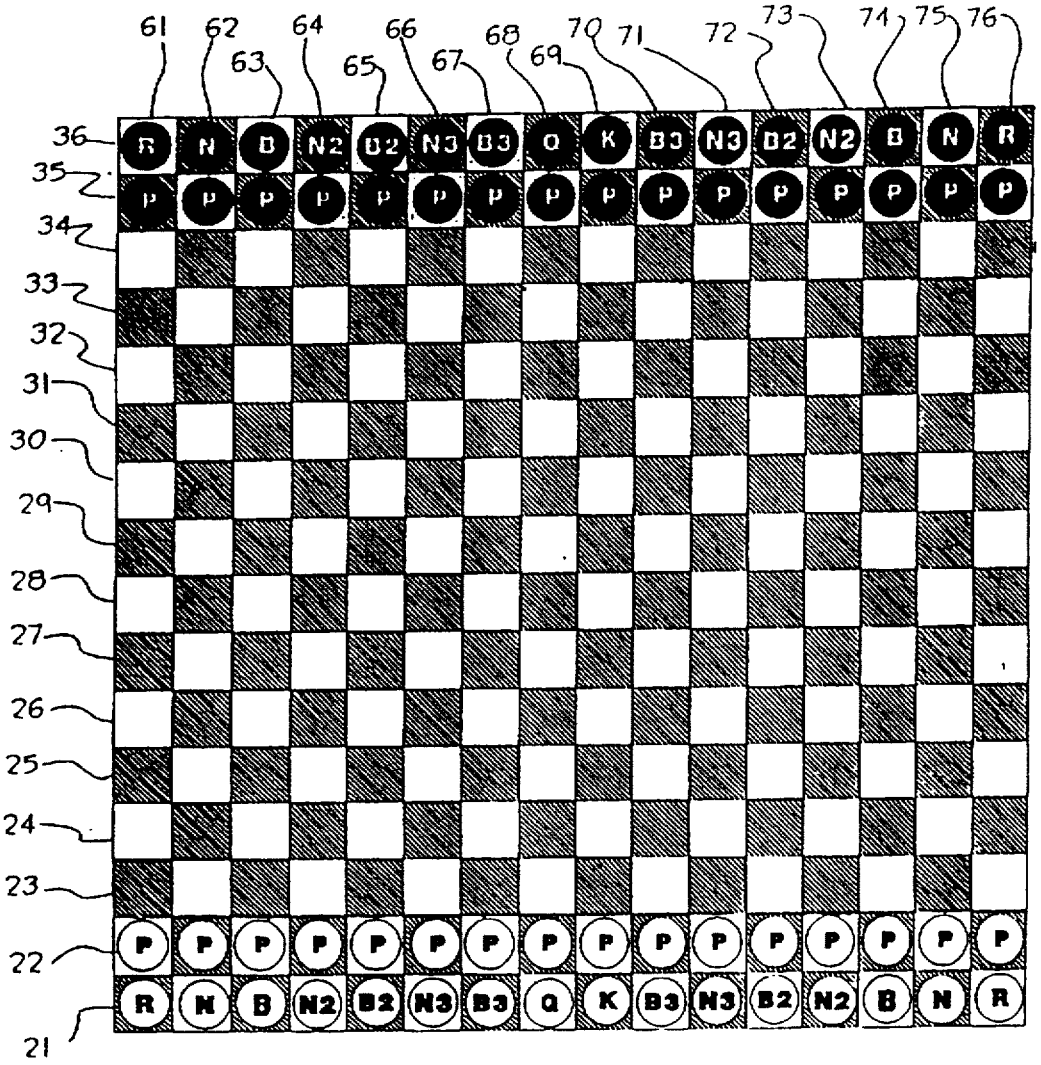
FIG. 14 is a plan view of the playing surface showing the set up of the game pieces with one row of pawns for each player version of the game on the 16 by 16 squares version of the game board.

To play the Expanded Chess Game upon the playing surface, as shown in FIG. 12, a first player initially places sixteen of the first set of game pieces upon the first row, as read from left to right from the first player's vantage point, as rook, knight, bishop, knight-2, bishop-2, knight-3, bishop-3, queen, king, bishop-3, knight-3, bishop-2, knight-2, bishop, knight and rook, sixteen of the pawns upon the second row and sixteen of the pawns upon the third row. A second player initially places sixteen of the second set of game pieces upon the sixteenth row, as read from left to right from the first player's vantage point, as rook, knight, bishop, knight-2, bishop-2, knight-3, bishop-3, queen, king, bishop-3, knight-3, bishop-2, knight-2, bishop, knight, and rook sixteen of the pawns upon the fifteenth row and sixteen of the pawns upon the fourteenth row. The pieces are placed such that the kings are in a same column. Optionally, as a variant to the expanded game as shown in FIG. 14, both players may play the game with only one row of sixteen pawns per player instead of two rows with thirty-two pawns per player. As shown in FIG. 14, in such a variant, the first player sets up his row of sixteen pawns only on the second row while the second player sets up his row of sixteen pawns only on the fifteenth row.

Play begins as in the traditional game of chess with each player moving his pieces in turn while observing the rules of chess and also the allowable movement of the game pieces. The castling move is modified to include the movement of the king at least two squares but not more than four squares in a direction along the initial row of placement and the simultaneous placement of either rook in a square adjacent the king, the square adjacent the king being located on a side opposite a rook square of origin, and provided no other game pieces obstruct the movement of the king or the rook and provided further that the king and rook have not been previously moved.

Figure 10:
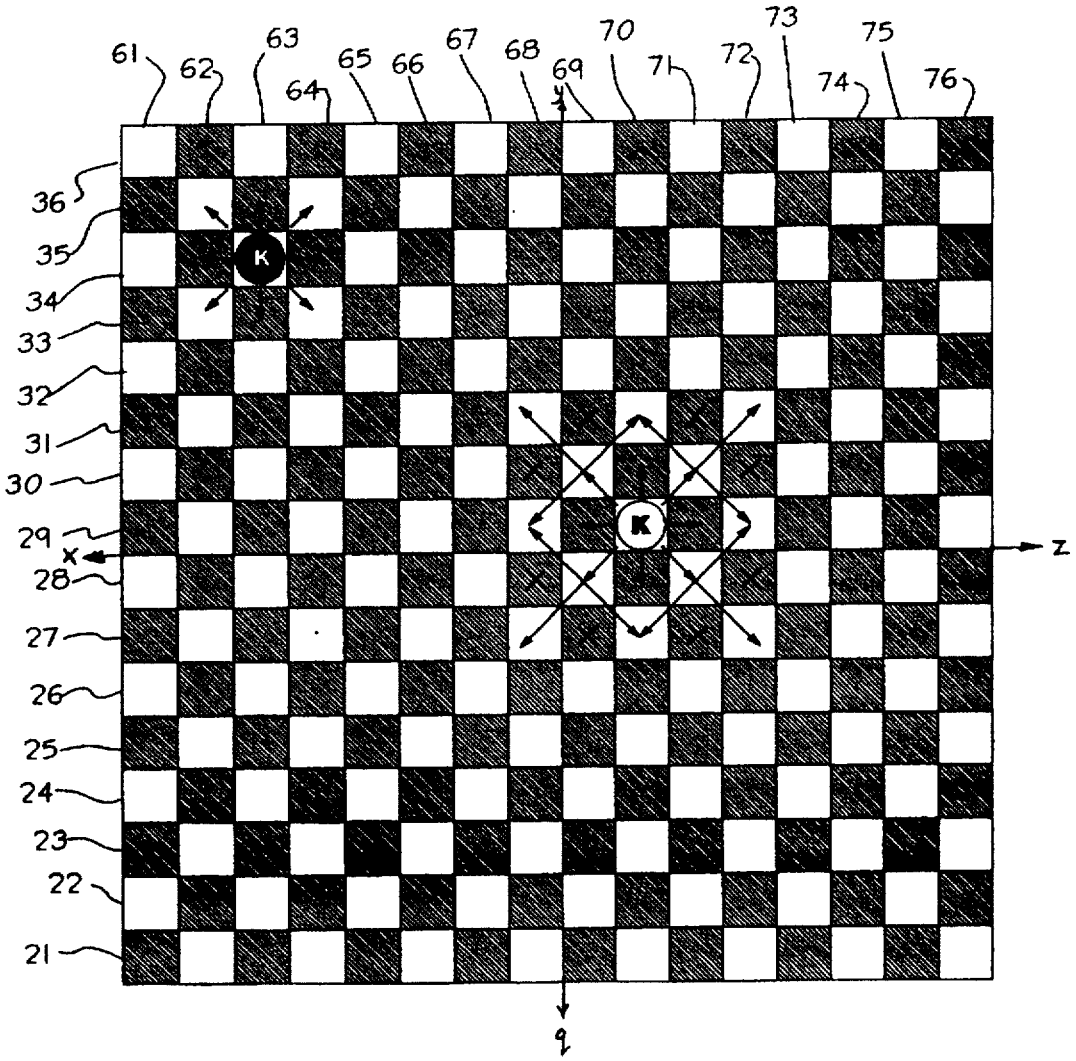
FIG. 10 is a plan view of the playing surface showing the allowable movement of the king game piece for player one and of the king game piece for player two in player one's territory.

Additionally, with reference to FIG. 10, for play upon the extended sixteen by sixteen squares playing surface, once the first player has moved his king into the second player's territory, the first player may then move his king in each of his following turns up to two squares in either a diagonal or zigzag fashion directions, or jump in the fashion of the knight's move, for the rest of the game. The second player's territory is defined as any square located on rows nine through sixteen. This is illustrated in FIG. 10 by the white K at row nine 29 and column ten 70. Similarly, once the second player has moved his king into the first player's territory, the second player may then move his king in each of his following turns up to two squares in either a diagonal or zigzag fashion directions, or jump in the fashion of the knight's move, for the rest of the game. The first player's territory being defined as any square located on rows one through eight.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An Expanded Chess Game Apparatus for play by a first player against a second player comprising:

a rectangular game board having a playing surface comprising sixteen rows and sixteen columns of alternating colored squares;

a reducer having four lateral sides in surrounding relationship with a rectangular aperture formed therebetween, the reducer being positionable upon the rectangular game board and forming a reduced playing surface comprising twelve rows and twelve columns of alternating colored squares;

a first set of game pieces for play upon the reduced playing surface comprising a king, a queen, two rooks, two bishop-2's, two knight-2's, two bishops, two knights and a plurality of pawns, the king, the queen, the rooks, the bishops, the knights and said pawns operating according to the rules of a traditional chess game; and a second set of game pieces for play upon the reduced playing surface comprising a king, a queen, two rooks, two bishop-2's, two knight-2's, two bishops, two knights and a plurality of pawns, the king, the queen, the rooks, the bishops, the knights and the pawns operating according to the rules of the traditional chess game, the second set of game pieces being distinguishable from the first set of game pieces; and wherein said first set of game pieces has twelve pawns and said second set of game pieces has twelve pawns.

2. The Expanded Chess Game Apparatus of claim 1, wherein said first set of game pieces has twenty-four pawns and said second set of game pieces has twenty-four pawns.

3. The Expanded Chess Game Apparatus of claim 1, wherein the bishop-2 is constrained to move from a bishop-2 square of origin to a bishop-2 destination square in a zigzag fashion, the bishop-2 destination square being of a same color as a color of the bishop-2 square of origin and being located on a row including the bishop-2 square of origin or within one row of the row including the bishop-2 square of origin, or being located on a column including the bishop-2 square of origin or within one column of the column including the bishop-2 square of origin.

4. The Expanded Chess Game Apparatus of claim 1, wherein the knight-2 is constrained to move from a knight-2 square of origin to a knight-2 destination square, the knight-2 destination square comprising all allowable destination squares of the knight and also comprising all squares arrived at by a movement of the knight-2 six squares inclusive of the knight-2 square of origin in any manner which includes a right angle movement, the movement of the knight-2 excluding diagonal movement.

5. The Expanded Chess Game Apparatus of claim 1, wherein said first set of game pieces has sixteen pawns, and wherein said first set of game pieces further comprises two knight-3's, and two bishop-3's for play upon the playing surface, said pawns operating according to the rules of the traditional game of chess, and wherein said second set of game pieces has sixteen pawns, and wherein said second set of game pieces further comprises two knight-3's, and two bishop-3's for play upon the playing surface, said pawns operating according to the rules of the traditional game of chess.

6. The Expanded Chess Game Apparatus of claim 5, wherein said first set of game pieces has sixteen additional pawns and said second set of game pieces has sixteen additional pawns, said additional pawns operating according to the rules of the traditional game of chess.

7. The Expanded Chess Game Apparatus of claim 5, wherein the knight-3 is constrained to move from a knight-3 square of origin to a knight-3 destination square, the knight-3 destination square comprising all knight-2 destination squares and also comprising all squares arrived at by a movement of the knight-3 eight squares inclusive of the knight-3 square of origin in any manner which includes a right angle movement, the movement of the knight-3 excluding diagonal movement.

8. The Expanded Chess Game Apparatus of claim 5, wherein the bishop-3 is constrained to move from a bishop-3 square of origin to a bishop-3 destination square, the bishop-3 destination square comprising all allowable bishop destination squares and bishop-2 destination squares.

9. The Expanded Chess Game Apparatus of claim 5, wherein said knight-3 has a knight-3 upper portion and a knight-3 base, said knight-3 upper portion having a pair of lateral horse-shaped members and a middle horse-shaped member being attached to said lateral horse-shaped members, said knight-3 upper portion being attached to said knight-3 base, and wherein said bishop-3 has an elongated section, a bishop-3 base, and a bishop-3 ball, said elongated section having a bore formed therethrough, a narrow end, and a curved end, said bishop-3 base being attached to said elongated section narrow end, and said bishop-3 ball being attached to said elongated section curved end.

10. The Expanded Chess Game Apparatus of claim 1, wherein said knight-2 has a knight-2 upper portion and a knight-2 base, said knight-2 upper portion having a first horse-shaped member and a second horse-shaped member and said knight-2 base being attached to said knight-2 upper portion, and wherein said bishop-2 has a conical section, a bishop-2 base, and a bishop-2 ball, said conical section having a large end and small end, a bishop-2 base being attached to said conical section large end, and said bishop-2 ball being attached to said conical section small end.

11. A Method of Playing An Expanded Chess Game for play by a first player against a second player comprising the steps of:

providing a rectangular game board having a playing surface comprising sixteen rows and sixteen columns of alternating colored squares;

providing a reducer comprising four lateral sides in surrounding relationship with a rectangular aperture formed therebetween, the reducer being positionable upon the rectangular game board and forming a reduced playing surface comprising twelve rows and twelve columns of alternating colored squares;

providing a first set of game pieces for play upon the reduced playing surface comprising a king, a queen, two rooks, two bishop-2's, two knight-2's, two bishops, two knights and a plurality pawns, the king, the queen, the rooks, the bishops, the knights, and the pawns operating according to the rules of a traditional chess game;

providing a second set of game pieces for play upon the reduced playing surface comprising a king, a queen, two rooks, two bishop-2's, two knight-2's, two bishops, two knights and a plurality of pawns, the king, the queen, the rooks, the bishops, the knights and the pawns operating according to the rules of the traditional chess game, the second set of game pieces being distinguishable from the first set of game pieces;

wherein the bishop-2 is constrained to move from a bishop-2 square of origin to a bishop-2 destination square in a zigzag fashion, the bishop-2 destination square being of a same color as the color of the bishop-2 square of origin and located on a row including the bishop-2 square of origin or within one row of the row including the bishop-2 square of origin, or being located on a column including the bishop-2 square of origin or within one column of the column including the bishop-2 square of origin; and wherein the knight-2 is constrained to move from a knight-2 square of origin to a knight-2 destination square, the knight-2 destination square comprising all allowable destination squares of the knight and also comprising all squares arrived at by a movement of the knight-2 six squares inclusive of the knight-2 square of origin in any manner which includes a right angle movement, the movement of the knight-2 excluding diagonal movement.

12. The Method of Playing An Expanded Chess Game of claim 11, wherein the plurality of pawns for said first set of game pieces is at least twelve pawns, and the plurality of pawns for said second set of game pieces is at least twelve pawns, and further comprising the step of the first player initially placing twelve of the first set of game pieces upon a first row as rook, knight, bishop, knight-2, bishop-2, queen, king, bishop-2, knight-2, bishop, knight and rook, and twelve of said pawns upon a second row, and the second player initially placing twelve of the second set of game pieces upon a twelfth row as rook, knight, bishop knight-2, bishop-2, queen, king, bishop-2, knight-2, bishop, knight, and rook, and twelve of said pawns upon an eleventh row, the kings being placed in a same column.

13. The Method of Playing An Expanded Chess Game of claim 12, further comprising the step of providing an additional twelve pawns of the first set of game pieces and providing an additional twelve pawns of the second set of game pieces, and further comprising the step of initially placing the twelve additional pawns of the first set of game pieces upon a third row and initially placing the twelve additional pawns of the second set of game pieces upon a tenth row.

14. The Method of Playing An Expanded Chess Game of claim 11, wherein the first player may move the king located on the first row at least two squares in a direction along the first row but not more than three squares in the direction and simultaneously move either rook located on the first row to a square adjacent the king, the square adjacent the king being located on a side opposite a rook square of origin, and provided no other game pieces obstruct the movement of either the king or the rook, and further provided that the king and rook have not been previously moved, and the second player may move the king located on the twelfth row at least two squares in a direction along the twelfth row but not more than three squares in the direction and simultaneously move either rook located on the twelfth row to a square adjacent the king, the square adjacent the king being located on a side opposite a rook square of origin, and provided no other game pieces obstruct the movement of either the king or the rook, and provided further that the king and rook have not been previously moved.

15. A Method of Playing An Expanded Chess Game for play by a first player against a second player comprising the steps of:

providing a rectangular game board having a playing surface comprising sixteen rows and sixteen columns of alternating colored squares;

providing a first set of game pieces for play upon the playing surface comprising a king, a queen, two rooks, two bishop-3's, two bishop-2's, two knight-3's, two knight-2's, two bishops, two knights and a plurality of pawns, the king, the queen, the rooks, the bishops, the knights, and the pawns operating according to the rules of a traditional chess game;

providing a second set of game pieces for play upon the playing surface comprising a king, a queen, two rooks, two bishop-3's, two bishop-2's, two knight-3's, two knight-2's, two bishops, two knights and a plurality pawns, the king, the queen, the rooks, the bishops, the knights and the pawns operating according to the rules of the traditional chess game, the second set of game pieces being distinguishable from the first set of game pieces;

wherein the bishop-2 is constrained to move from a bishop-2 square of origin to a bishop-2 destination square in a zigzag fashion, the bishop-2 destination square being of a same color as the color of the bishop-2 square of origin and located on a row including the bishop-2 square of origin or within one row of the row including the bishop-2 square of origin, or being located on a column including the bishop-2 square of origin or within one column of the column including the bishop-2 square of origin;

wherein the bishop-3 is constrained to move from a bishop-3 square of origin to a bishop-3 destination square, the bishop-3 destination square comprising all allowable bishop destination squares and bishop-2 destination squares;

wherein the knight-2 is constrained to move from a knight-2 square of origin to a knight-2 destination square, the knight-2 destination square comprising all allowable destination squares of the knight and also comprising all squares arrived at by a movement of the knight-2 six squares inclusive of the knight-2 square of origin in any manner which includes a right angle movement, the movement of the knight-2 excluding diagonal movement; and wherein the knight-3 is constrained to move from a knight-3 square of origin to a knight-3 destination square, the knight-3 destination square comprising all knight-2 destination squares and also comprising all squares arrived at by a movement of the knight-3 eight squares inclusive of the knight-3 square of origin in any manner which includes a right angle movement, the movement of the knight-3 excluding diagonal movement.

16. The Method of Playing An Expanded Chess Game of claim 15 wherein the plurality of pawns for said first set of game pieces is at least sixteen pawns, and the plurality of pawns for said second set of game pieces is at least sixteen pawns, further comprising the step of the first player initially placing sixteen of the first set of game pieces upon a first row as rook, knight, bishop, knight-2, bishop-2, knight-3, bishop-3, queen, king, bishop-3, knight-3, bishop-2, knight-2, bishop, knight, and rook, and sixteen of the pawns upon a second row, and the second player initially placing sixteen of the second set of game pieces upon a sixteenth row as rook, knight, bishop, knight-2, bishop-2, knight-3, bishop-3, queen, king, bishop-3, knight-3, bishop-2, knight-2, bishop, knight, and rook, and sixteen of the pawns upon a fifteenth row, the kings being placed in a same column.

17. The Method of Playing An Expanded Chess Game of claim 16, further comprising the step of providing an additional sixteen pawns of the first set of game pieces and providing an additional sixteen pawns of the second set of game pieces, and further comprising the step of initially placing the sixteen additional pawns of the first set of game pieces upon a third row and initially placing the sixteen additional pawns of the second set of game pieces upon a fourteenth row.

18. The Method of Playing An Expanded Chess Game of claim 15 wherein the first player may move the king located on the first row at least two squares in a direction along the first row but not more than four squares in the direction and simultaneously move either rook located on the first row to a square adjacent the king, the square adjacent the king being located on a side opposite a rook square of origin, and provided no other game pieces obstruct the movement of either the king or the rook, and further provided that the king and rook have not been previously moved, and the second player may move the king located on the sixteenth row at least two squares in a direction along the sixteenth row but not more than four squares in the direction and simultaneously move either rook located on the sixteenth row to a square adjacent the king, the square adjacent the king being located on a side opposite a rook square of origin, and provided no other game pieces obstruct the movement of either the king or the rook, and provided further that the king and rook have not been previously moved.

19. The Method of Playing An Expanded Chess Game of claim 18 wherein once the first player has moved the king originally placed upon the first row into the second player's territory, the second player's territory being defined as any square located on rows nine through sixteen, the first player may move the king in the rest of the first player's following turns up to two squares in either a diagonal or zigzag fashion directions, or jump in the fashion of the knight's move, and wherein once the second player has moved the king originally placed upon the first row into the first player's territory, the first player's territory being defined as any square located on rows one through eight the second player may move the king in the rest of the second player's following turns up to two squares in either a diagonal or zigzag fashion directions, or jump in the fashion of the knight's move.

* * * * *